US007533600B2

(12) United States Patent
Marqueling

(10) Patent No.: US 7,533,600 B2
(45) Date of Patent: May 19, 2009

(54) ARMOR ASSEMBLY FOR A TRUCK

(75) Inventor: Mark R. Marqueling, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 185 days.

(21) Appl. No.: 11/428,069

(22) Filed: Jun. 30, 2006

(65) Prior Publication Data

US 2009/0100999 A1 Apr. 23, 2009

(51) Int. Cl.
*F41H 5/14* (2006.01)

(52) U.S. Cl. ..... 89/36.09

(58) Field of Classification Search ..... 89/36.07, 89/36.08, 36.09

See application file for complete search history.

(56) References Cited

U.S. PATENT DOCUMENTS 546,890 A * 9/1895 Karnatz ..... 362/478
1,632,360 A * 6/1927 Wilson ..... 296/24.37
1,745,299 A * 1/1930 Holan ..... 160/88
2,656,765 A * 10/1953 Raymond ..... 89/36.09
3,590,685 A * 7/1971 Lane ..... 89/36.09
4,235,047 A 11/1980 Turner
4,236,441 A 12/1980 Turner et al.
5,340,189 A * 8/1994 Goodman ..... 296/152
5,533,778 A * 7/1996 Sheridan ..... 296/152
5,576,508 A * 11/1996 Korpi ..... 89/36.01
5,679,918 A * 10/1997 Korpi et al. ..... 89/36.08
5,703,316 A * 12/1997 Madden, Jr. ..... 89/36.08
5,857,730 A * 1/1999 Korpi et al. ..... 296/146.1
6,711,980 B2 * 3/2004 Kropf ..... 89/36.09

* cited by examiner

*Primary Examiner*—Bret Hayes
(74) *Attorney, Agent, or Firm*—Mark C. Bach; Jeffrey P. Calfa

(57) ABSTRACT

An armor assembly for a vehicle having a body frame includes an inner ballistic panel attached to the body frame of the vehicle, and an outer ballistic panel attached to the body frame. The outer ballistic panel is pivotably disposed with respect to the inner ballistic panel and is pivotable from a first position generally adjacent and parallel to the inner ballistic panel, to a second position generally 180-degrees from the first position.

13 Claims, 2 Drawing Sheets

ARMOR ASSEMBLY FOR A TRUCK

BACKGROUND OF THE INVENTION

The present invention relates generally to armor assemblies in vehicles. More specifically, the present invention relates to an armor assembly mounted on a vehicle in which the footprint of protection can be varied.

A vehicle is typically armored for combat by applying ballistic composite panels to the vehicle's frame surfaces. The panels can be made from various materials, such as metals or ceramics, and are designed to stop high velocity projectiles from traveling through the panel and into the vehicle. Armored vehicles may be built to meet a mixture of kinetic energy threats and non-kinetic energy threats, including gunfire, tank artillery, automatic weapons, missiles and atomic threats.

Since armor assemblies on a vehicle must strike a reasonable balance between weight, mobility and protection, only selected portions of the vehicle surface are typically armored. For this reason, a vehicle passenger must position him or herself behind the armor such that the armor assembly is located between the enemy fire and the vehicle passenger. For example, if a portion of the door is armored with a ballistic panel, the vehicle passenger must position him or herself behind the portion of the door having the panel. In some cases, due to constraints on where the ballistic panels can be placed on the vehicle, the panels may not provide an effective barrier in portions of the vehicle where the passenger is likely to be located.

Armor assemblies can also be movable with portions of the vehicle or with respect to portions of the vehicle. Since the ballistic panels are frequently heavy or placed at inaccessible locations, positioning the ballistic panel often requires an actuator or other mechanical systems to move it into place. One problem with relying on actuators or other mechanical systems is that these systems can full, particularly in situations were the vehicle has been debilitated. Further, the more complicated the mechanism to position the ballistic panel into place, the more susceptible the mechanism is to system failures.

A further problem with armored vehicles is that the vehicle may outlive the useful life of the armor. A combat vehicle may be maintained in the military inventory for many years before becoming obsolete. During this time period, various improvements in antiballistic materials may be invented or discovered. In prior art vehicles, the armor is placed in locations on the vehicle that make drastic vehicle reconstruction necessary in order to update the vehicle's armor.

Thus, there is a need for an armored vehicle design in which the footprint of protection can be varied.

There is a further need for an armored vehicle design where the antiballistic properties of the vehicle can be varied over time.

There is also a need for an armored vehicle design that provides the advantages of manual actuation of a heavy armored door with little danger to the operator.

BRIEF SUMMARY OF THE INVENTION

The above-listed needs are met or exceeded by the present armor assembly for a vehicle having a body frame. The armor assembly includes an inner ballistic panel attached to the body frame of the vehicle, and an outer ballistic panel attached to the body frame. The outer ballistic panel is pivotably disposed with respect to the inner ballistic panel and is pivotable from a first position generally adjacent and parallel to the inner ballistic panel, to a second position generally 180-degrees from the first position.

An alternate embodiment of an armor assembly for a vehicle having a body frame and at least one door hinged to the body frame is provided. The armor assembly includes an inner ballistic panel attached to the door of the vehicle, and an outer ballistic panel attached to the door. The outer ballistic panel is moveable with respect to the inner ballistic panel, and is moveable from a first position at least partially overlapping the inner ballistic panel, to a second position forming a generally continuous ballistic barrier with the inner ballistic panel. The second position provides increased protective surface area over the first position.

Another embodiment of an armor assembly for a vehicle having a body frame and at least one door hinged to the body frame is provided. The armor assembly includes an inner ballistic panel attached to the door of the vehicle, and an outer ballistic panel attached to the door and pivotably disposed with respect to the inner ballistic panel. The outer ballistic panel is pivotable from a first position generally parallel to the inner ballistic panel, to a second position generally 180-degrees from the first position. A pulley assembly is disposed on the door and has a cord with a first end attached to the outer ballistic panel, and a second end located on an inside surface of the door. The outer ballistic panel is pivoted between the first and second positions by extending and retracting the cord.

DETAILED DESCRIPTION OF THE INVENTION

Figure 1:
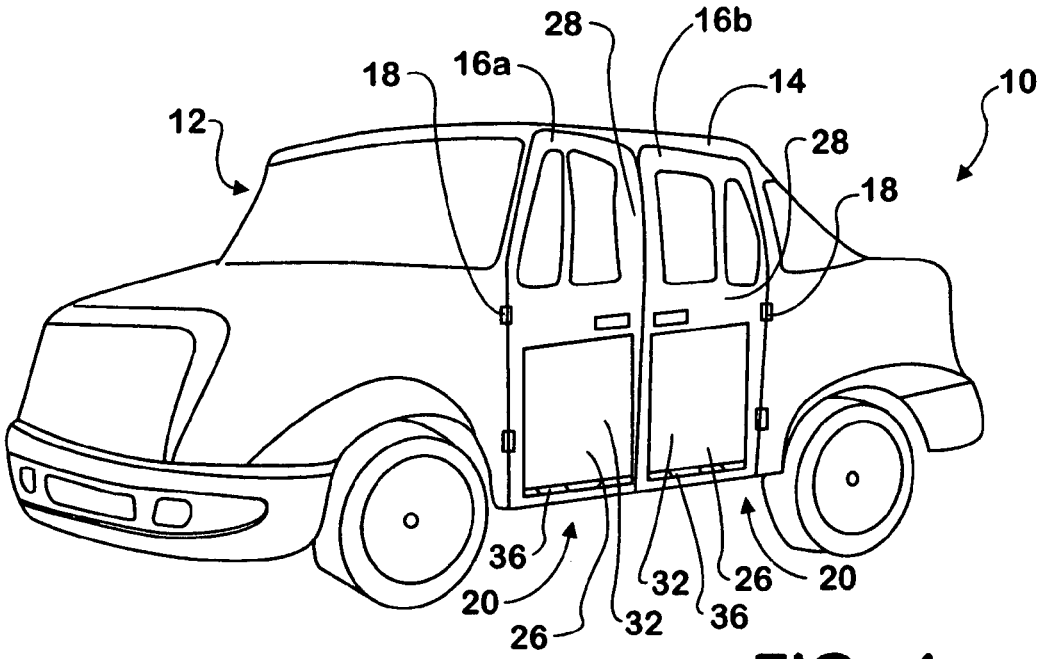
FIG. 1 is a perspective view of a vehicle using an armor assembly made in accordance with this invention.

Referring now to FIG. 1, a motor vehicle 10 includes a passenger carrying body 12 for housing passengers of the vehicle. Providing the structure for the passenger carrying body 12 is a body frame 14. At least one, but preferably a plurality of doors 16 are located at both the driver's side and passenger's side of the vehicle 10, and are mounted to the body frame 14 with door hinges 18. Preferably, each door 16 includes an armor assembly, indicated generally at 20.

The motor vehicle 10 can be a civilian vehicle, or can also be a military vehicle, such as a tank, a personnel carrier, a landing vehicle, a fuel tanker, and a reconnaissance vehicle. In the preferred embodiment, the vehicle 10 is a vehicle having four doors 16*a*, 16*b*, 16*c* and 16*d*, with two of the doors 16*a*, 16*b* on the driver's side and two of the doors 16*c*, 16*d* on the passenger's side. The armor assembly 20 is preferably located on each door 16 of the vehicle 10 at the lower portion of the door. While the preferred embodiment of armor assembly 20 is located on the doors 16, it is contemplated that the armor assembly can also be implemented on other portions of a vehicle 10, such as on the body frame 14, and further, the armor assembly can be used on non-vehicular objects.

Figure 2:
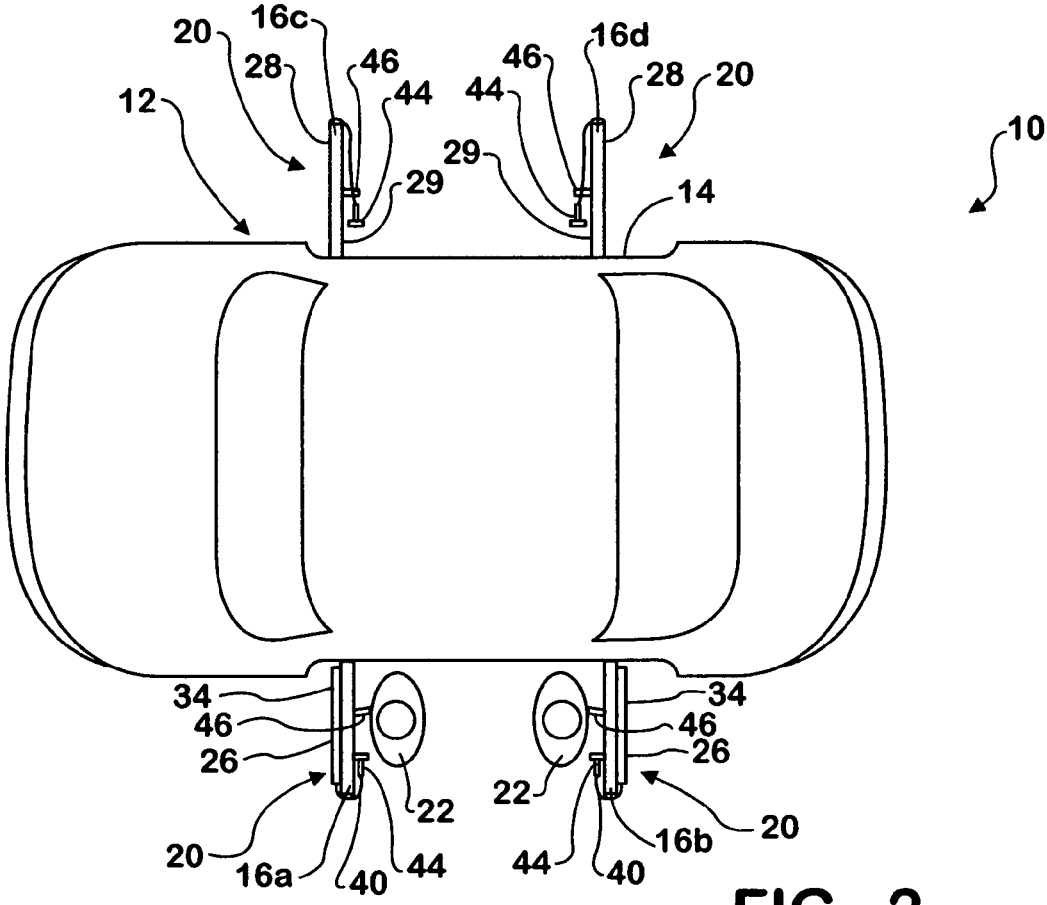
FIG. 2 is a top view of the vehicle shown in FIG. 1 with two vehicle doors open and the armor assembly in the first position, and two vehicle doors with the armor assembly in the second position.

Referring now to FIG. 2, the four doors 16*a-d* are shown opened generally perpendicularly from the body frame 14. Each door 16 opens from the body frame 14 at the door hinges 18. As seen in FIG. 1, the door hinges 18 are preferably located at the sides of the doors 16 such that the front door 16*a* pivots about the body frame 14 towards the front of the vehicle, and the back door 16*b* pivots about the body frame 14 towards the back of the vehicle. While it is contemplated that the doors 16 can also open in a conventional manner, in the preferred configuration, a large open space is formed between the doors 16*a* and 16*b* for vehicle passengers 22 to stand adjacent the vehicle 10 in the open space (See FIG. 2).

The vehicle 10 preferably has the four-door arrangement described above so that if the vehicle 10 comes under attack from either the rear direction of the vehicle 10, the forward direction of the vehicle, or both directions, the vehicle passenger 22 can stand adjacent the vehicle (for example, to return fire) and be located behind an armor assembly 20. Also, if the vehicle 10 were to come under fire from the side of the vehicle, the doors 16*a*, 16*b* can be opened at various acute angles to the body frame 14 such that passengers 22 can stand behind the doors and be protected from projectiles fired from various directions.

Figure 3:
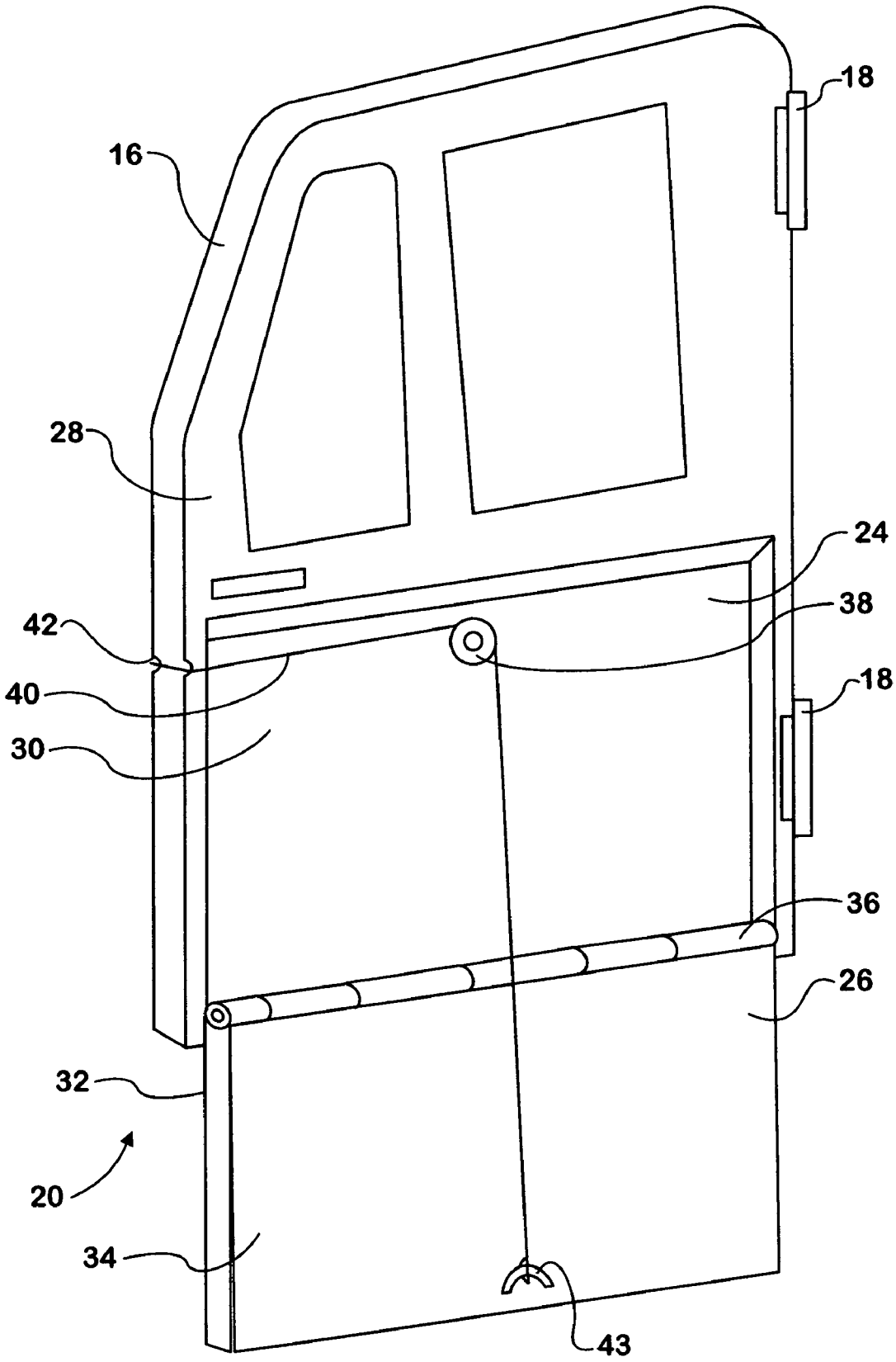
FIG. 3 is a perspective view of a vehicle door having the armor assembly in the extended, second position.

In FIGS. 1-3, the armor assembly 20 includes an inner ballistic panel 24 and an outer ballistic panel 26 mounted on an outside surface 28 of the door 16. The ballistic panels 24, 26 are preferably made of materials known to one in the art, such as monolithics, composite materials, ceramics, or any other materials of sufficient strength to provide a protective barrier. Preferably, the materials for ballistic panels 24, 26 can be selected in accordance with the technology existing at the time of initial installation or at any later date. Since materials technology is continually advancing, the panels 24, 26 are designed and arranged to be accessible and easily replaced with updated panels.

In the preferred embodiment, the inner ballistic panel 24 is preferably attached directly to the door 16, and is inset in the width direction of the door such that a receiving surface 30 of the inner ballistic panel is also inset from the outer surface 28 of the door. The inner ballistic panel 24 has a width sufficient to form a protective barrier, depending on the type of material used, but preferably has a width equal to or less than the width of the door 16 so that it can be inset in the door. Alternatively, the inner panel 24 may be mounted to the door 16 such that it is flush with or protrudes from the outer surface 28 of the door.

Preferably, the first ballistic panel 24 is attached to the vehicle door 16 such that it is accessible at the outer surface 28 of the door. The attachment can be accomplished in a variety of different ways. For example, bolts (not shown) can be threaded into blind holes in the door 16. Alternatively, more than one panel 24 can span the door 16, however, adjacent panels should have their edges abutted together to define a substantially uninterrupted receiving surface 30. Alternatively, the first ballistic panel 24 may be accessible from an inner surface 29 of the door. Since both the inner ballistic panel 24 and the outer ballistic panel 26 are accessible from either the inner surface 29 or outer surface 28 of the door 16, and further, are preferably mounted in a relatively simple mechanical attachment, the ballistic panels can be easily removed, replaced or updated.

The outer ballistic panel 26 has two positions. The first position of the outer ballistic panel 26 is generally aligned with and parallel to the inner ballistic panel 24, and is shown in FIG. 1. In the preferred embodiment, the inner ballistic panel 24 and the outer ballistic panel 26 are generally of similar size and complementary shape, and a receiving surface 30 of the inner ballistic panel is generally parallel to a protective surface 32 of the outer ballistic panel 26.

While the preferred embodiment of armor assembly 20 employs panels of generally the same size and shape, it is contemplated that various shapes of panels may be used, with the outer ballistic panel 26 at least partially overlapping with the inner ballistic panel 24. It is also contemplated that the panels 24, 26 may have slight curvature, but the general alignment of the inner ballistic panel 24 and the outer ballistic panel 26 is preferably generally parallel. In this first position, a receiving surface 34 of the outer ballistic panel 26 is generally flush with the outside surface 28 of the door 16.

The outer ballistic panel 26 is preferably pivotable about a hinge 36 from the first position (shown in FIG. 1), generally 180-degrees to a second position (shown in FIG. 3). In the second position, the inner ballistic panel 24 remains in the same position attached to the door 16, and the outer ballistic panel 26 preferably swings down under gravity such that the outer ballistic panel generally forms a continuous ballistic barrier with the inner ballistic panel. The continuous ballistic barrier formed in the second position provides an increased surface area of protection over the first position. Alternately, the panels 24, 26 may not form a continuous barrier with each other, but instead provide a discontinuous barrier having an increased footprint or surface area of protection.

While the preferred embodiment has a pivotable relationship between the outer ballistic panel 26 and the inner ballistic panel 24, it is contemplated the panels can be moved with respect to each other in other ways. For example, the outer ballistic panel 26 can be slidably mounted on the inner ballistic panel 24 and configured to slide from a first position, generally adjacent and parallel to the inner ballistic panel, to a second position, generally parallel to the inner ballistic panel. Further, it is contemplated that the outer ballistic panel 26 can be moved upwards or to the various sides of the inner ballistic panel 24 to increase the footprint of protection. Further still, it is contemplated that more than two panels can be incorporated on the armor assembly 20.

When the preferred embodiment of armor assembly 20 is pivoted, the outer ballistic panel 26 is sized and shaped, in accordance with the vehicle 10 it is mounted on, to make contact with the ground to provide a protective barrier from the top of the inner ballistic panel 24 down to the bottom of the outer ballistic panel. In this configuration, the outer ballistic panel 24 can provide protection to the lower extremities of the passengers 22 who may be located behind the doors 16.

Further, the outer ballistic panel 26 is hinged either directly to the door 16 or to the inner ballistic panel 24 at the hinge 36 to prevent the panel from swinging more than generally 180-degrees should the panel not contact the ground. The hinge 36 is preferably located at or adjacent a lower portion of the inner ballistic panel 24. The outer ballistic panel 26 is configured to pivot about the outer surface 28 of the door 16 so that the passenger 22 potentially standing behind the door 16 does not involuntarily impede the swinging action (or other movement) of the panel 26 into the second position.

As seen in FIG. 3, the movement of the outer ballistic panel 26 is controlled by a control system, preferably a pulley assembly 38, although other mechanical or electrical systems are contemplated. The pulley assembly 38 is preferably located on the door 16 and is preferably inset in the inner ballistic panel 24, or is mounted in any other manner that permits the outer ballistic panel 26 to move from the first position to second position. In the preferred embodiment, the pulley assembly 38 includes a cord 40 that is fed in a cord channel 42 around the side of the door 16, or alternately, through a hole in the door (not shown). The first end of the cord 40 is attached to the outer ballistic panel 26, preferably at an attachment structure 43.

As seen in FIG. 2, a handle 44 is located at the second end of the cord 40 and at the inside surface 29 of the door 16.

Placing the handle 44 in a locking device, for example a hook 46, preferably locks the handle 44. The handle 44 is maintained in the locked position behind the hook 46 which prevents the cord 40 from extending until the passenger 22 activates the armor assembly 20. When the passenger 22 takes the handle 44 out of the locked position, permitting the handle 44 to move with respect to the door 16, and permitting the cord 40 to extend from the pulley assembly 38, the outer ballistic panel 26 is pivoted from the first to the second position. The doors 16*a* and 16*b* of FIG. 2 are shown with the armor assembly 20 in the second position. When the passenger 22 withdraws the outer ballistic panel 26 to resume the first position, the handle 44 of the pulley assembly 38 is pulled, the cord 40 is retracted, and the handle can be locked behind the hook 46. The doors 16*c* and 16*d* of FIG. 2 are shown with the armor assembly 20 in the first position.

While the pulley assembly 38 is the preferred control system, it is contemplated that other systems can be implemented. Further, while a hook 46 is used as a locking device, other ways of preventing the pulley assembly 38 from extending to the second position are also contemplated. It is also contemplated that an automatic, powered linkage could be integrated into the control system that would automatically withdraw the outer ballistic panel 26 to the first position when the door 16 is closed. While particular embodiments of the present armor assembly for a vehicle have been shown and described, it will be appreciated by those skilled in the art that changes and modifications may be made thereto without departing from the invention in its broader aspects and as set forth in the following claims.

I claim:

1. An armor assembly for a vehicle having at least one door, the armor assembly comprising:

an inner ballistic panel attached to an exterior surface of at least one door of a vehicle, wherein said exterior surface is exterior to a vehicle when a at least one door is closed;

an outer ballistic panel attached to the exterior surface of at least one door and pivotably disposed with respect to said inner ballistic panel, wherein said outer ballistic panel is exterior to said inner ballistic panel, wherein said outer ballistic panel is pivotable from a first position generally parallel to said inner ballistic panel, to a second position generally 180-degrees from said first position; and a control system mounted on a vehicle for controlling the pivoting of said outer ballistic panel, wherein said control system further comprises a pulley assembly having a cord with one end attached to an attachment structure on said outer ballistic panel.

2. The armor assembly of claim 1 wherein said outer ballistic panel pivots about a hinge disposed on one of a lower portion of said inner ballistic panel and a lower portion of at least one door.

3. The armor assembly of claim 1 wherein said cord has a second end located on an interior surface of at least one door, wherein said interior surface is interior to a vehicle when at least one door is closed.

4. The armor assembly of claim 1 wherein when said outer ballistic panel is in the second position, a generally continuous ballistic barrier is formed with said inner ballistic panel providing an increased surface area of protection than in the first position.

5. The armor assembly of claim 1 wherein said inner ballistic panel and said outer ballistic panel have generally the same size and shape.

6. An armor assembly for a vehicle having at least one door, comprising:

an inner ballistic panel attached to an exterior surface of at least one door of a vehicle, wherein said exterior surface is exterior to a vehicle when at least one door is closed;

an outer ballistic panel attached to said exterior surface of at least one door and moveable with respect to said inner ballistic panel, wherein said outer ballistic panel is exterior to said inner ballistic panel;

wherein said outer ballistic panel is movable from a first position at least partially overlapping said inner ballistic panel, to a second position wherein said inner ballistic panel and said outer ballistic panel form a generally continuous ballistic barrier of increased surface area compared to the first position; and a control system mounted on a vehicle for controlling the pivoting of said outer ballistic panel, wherein said control system further comprises a pulley assembly having a cord with one end attached to an attachment structure on said outer ballistic panel.

7. The armor assembly of claim 6 wherein said outer ballistic panel is pivotable from said first position to said second position.

8. The armor assembly of claim 7 wherein said outer ballistic panel pivots about a hinge disposed on one of a lower portion of said inner ballistic panel and a lower portion of at least one door.

9. The armor assembly of claim 6 wherein said cord has a second end located on an interior surface of at least one door, wherein said interior surface is interior to a vehicle when at least one door is closed.

10. An armor assembly for a vehicle having at least one door, comprising:

an inner ballistic panel attached to an exterior surface of at least one door of a vehicle, wherein said exterior surface is exterior to a vehicle when at least one door is closed;

an outer ballistic panel attached to said exterior surface of at least one door and pivotably disposed with respect to said inner ballistic panel, wherein said outer ballistic panel is exterior to said inner ballistic panel;

wherein said outer ballistic panel is pivotable from a first position generally parallel to said inner ballistic panel to a second position generally 180-degrees from said first position; and a pulley assembly disposed on the at least one door and having a cord with a first end attached to said outer ballistic panel, and a second end located on an interior surface of at least one door, wherein said interior surface is interior to a vehicle when at least one door is closed;

wherein said outer ballistic panel is pivoted between the first and second positions by lengthening and retracting said cord.

11. The armor assembly of claim 10 wherein when said outer ballistic panel is in the second position, a generally continuous ballistic barrier is formed with said inner ballistic panel providing an increased surface area of protection compared to the first position.

12. The armor assembly of claim 10 wherein when said outer ballistic panel is in the second position, said outer ballistic panel is configured to extend down below at least one door to ground.

13. The armor assembly of claim 10 wherein said outer ballistic panel pivots about a hinge disposed on one of a lower portion of said inner ballistic panel and a lower portion of at least one door.

* * * * *